US007180486B2

(12) United States Patent
Jeong

(10) Patent No.: US 7,180,486 B2
(45) Date of Patent: Feb. 20, 2007

(54) ORGANIC LIGHT EMITTING DISPLAY

(75) Inventor: Jin Tae Jeong, Seoul (KR)

(73) Assignee: Samsung SDI Co., Ltd, Suwon-si (KR)

( * ) Notice: Subject to any disclaimer, the term of this patent is extended or adjusted under 35 U.S.C. 154(b) by 4 days.

(21) Appl. No.: 11/205,271

(22) Filed: Aug. 15, 2005

(65) Prior Publication Data

US 2006/0055336 A1 Mar. 16, 2006

(30) Foreign Application Priority Data

Aug. 30, 2004 (KR) ..... 10-2004-0068405

(51) Int. Cl.
*G09G 3/32* (2006.01)

(52) U.S. Cl. ..... 345/82; 345/76; 345/92

(58) Field of Classification Search ..... 345/55, 345/76, 77, 82, 92, 205; 315/169.3, 169.2, 315/169.1

See application file for complete search history.

(56) References Cited

U.S. PATENT DOCUMENTS 6,809,482 B2 10/2004 Koyama ..... 345/77
6,930,680 B2 * 8/2005 Miyazawa ..... 345/205
6,937,215 B2 * 8/2005 Lo ..... 345/82
6,975,293 B2 * 12/2005 Yen et al. ..... 345/82
2004/0145547 A1 * 7/2004 Oh ..... 345/76
2004/0196239 A1 * 10/2004 Kwon ..... 345/92
2005/0017934 A1 * 1/2005 Chung et al. ..... 345/82

* cited by examiner

*Primary Examiner*—Tuyet Vo
*Assistant Examiner*—Ephrem Alemu
(74) *Attorney, Agent, or Firm*—Christie, Parker & Hale, LLP

(57) ABSTRACT

An organic light emitting display includes a plurality of pixels, at least one of the pixels having: an organic light emitting diode; a driving transistor adapted to supply a driving current to the organic light emitting diode; a first switching transistor adapted to selectively supply a data signal to the driving transistor; a second switching transistor adapted to selectively supply an initialization signal; a third switching transistor adapted to selectively allow the driving transistor to be connected as a diode and to selectively supply the initialization sought; a storage capacitor adapted to store a first voltage corresponding to the initialization signal received from the third switching transistor and then to store a second voltage corresponding to the data signal applied at a gate electrode of the driving transistor; and an interrupter adapted to selectively supply a pixel power to the driving transistor and to selectively allow the driving current to flow into the organic light emitting diode. In this display, the amount of current leaking out through a switching transistor is decreased, and thus a voltage variance applied to a gate electrode of a driving transistor is decreased, thereby enhancing a contrast of an image.

21 Claims, 5 Drawing Sheets

ORGANIC LIGHT EMITTING DISPLAY

CROSS-REFERENCE TO RELATED APPLICATION

This application claims priority to and the benefit of Korean Patent Application No. 10-2004-0068405, filed on Aug. 30, 2004, in the Korean Intellectual Property Office, the entire content of which is incorporated herein by reference.

BACKGROUND

1. Field of the Invention

The present invention relates to an organic light emitting display, and more particularly, to an organic light emitting display which compensates a threshold voltage of a driving transistor to improve a uniformity in brightness.

2. Discussion of Related Art

Recently, various flat panel displays, which are thinner than a comparable cathode ray tube display, have been developed. As a flat panel display, an organic light emitting display has excellent emission efficiency, brightness and viewing angle, as well as a fast response time.

An organic light emitting diode (OLED) of an organic light emitting display has a structure that includes an emitting layer for emitting light interposed between a cathode electrode and an anode electrode. An electron and a hole are injected into the emitting layer and recombined in the emitting layer, so that an exciton is created and light is emitted when the exciton is transitioned to a low energy band.

FIG. 1 is a circuit diagram of a pixel in a conventional organic light emitting display. Referring to FIG. 1, the pixel includes an organic light emitting diode OLED, a driving transistor M2, a storage capacitor Cst, and a switching transistor M1. Further, a scan line Sn, a data line Dm, and a power source line Vdd are connected to the pixel. For reference, n is an arbitrary integer between 1 and N, and m is an arbitrary integer between 1 and M.

The switching transistor M1 includes a source electrode connected to the data line Dm, a drain electrode connected to a first node A, and a gate electrode connected to the scan line Sn.

The driving transistor M2 includes a source electrode connected to the power source line Vdd, a drain electrode connected to the organic light emitting diode OLED, and a gate electrode connected to the first node A. Here, a current required for emitting light is applied to the organic light emitting diode (OLED) in response to a signal inputted to the gate electrode of the driving transistor M2. Further, an intensity of the current applied to the driving transistor M2 is controlled by a data signal transmitted through the switching transistor M1.

A storage capacitor Cst includes a first electrode connected to the source electrode of the driving transistor M2, and a second electrode connected to the first node A, and is employed to maintain the voltage applied between the source electrode and the gate electrode of the driving transistor M2 for a predetermined period.

In operation, when the switching transistor M1 is turned on in response to a scan signal transmitted to the gate electrode of the switching transistor M1, the storage capacitor Cst is charged with a voltage corresponding to the data signal, and the voltage charged in the storage capacitor Cst is applied to the gate electrode of the driving transistor M2, so that the current flows through the driving transistor M2, thereby allowing the organic light emitting diode OLED to emit light.

At this time, the current flowing into the organic light emitting diode OLED from the driving transistor M2 is obtained by the following equation 1.

$$I_{OLED} = \frac{\beta}{2}(Vgs - Vth)^2 = \frac{\beta}{2}(Vdd - Vdata - |Vth|)^2 \quad \text{[equation 1]}$$

where, $I_{OLED}$ is a current flowing into the organic light emitting diode OLED; Vgs is a voltage applied between the source and gate electrodes of the driving transistor M2; Vth is the threshold voltage of the driving transistor M2; Vdd is a voltage source for the pixel; Vdata is a voltage of the data signal; and β is a gain factor of the driving transistor M2.

Referring to equation 1, the current $I_{OLED}$ is related to the threshold voltage Vth of the driving transistor M2.

However, when a conventional organic light emitting display is fabricated, a deviation may arise between threshold voltages of driving transistors (e.g., the driving transistor M2). The deviation between the threshold voltages of the driving transistors causes the intensity of currents flowing into organic light emitting diodes OLEDs to be not uniform, so that the conventional organic light emitting display displays an image with non-uniform brightness.

SUMMARY OF THE INVENTION

Accordingly, an embodiment of the present invention provides a pixel and an organic light emitting display, in which a current flows through a driving transistor regardless of a threshold voltage of the driving transistor, so that a difference between threshold voltages of driving transistors is compensated, thereby a brightness of the organic light emitting display is more uniform. In another embodiment, a pixel and an organic light emitting display further enhance a picture quality of the organic light emitting display by reducing a leakage current.

One embodiment of the present invention provides an organic light emitting display including: a plurality of scan lines adapted to transmit a scan signal; a plurality of data lines adapted to transmit a data signal; a plurality of emission control lines; and a plurality of pixels connected to the scan lines, the emission control lines and the data lines. In this embodiment, at least one of the pixels includes an organic light emitting diode; a driving transistor adapted to supply a driving current to the organic light emitting diode; a first switching transistor adapted to selectively supply the data signal to the driving transistor; a second switching transistor adapted to selectively supply an initialization signal; a third switching transistor adapted to selectively allow the driving transistor to be connected as a diode and to selectively supply the initialization signal; a storage capacitor adapted to store a first voltage corresponding to the initialization signal received from the third switching transistor and then to store a second voltage corresponding to the data signal applied at a gate electrode of the driving transistor; and an interrupter adapted to selectively supply a pixel power to the driving transistor and to selectively allow the driving current to flow into the organic light emitting diode.

One embodiment of the present invention provides a pixel including: an organic light emitting diode; a driving transistor adapted to supply a driving current to the organic light emitting diode; a first switching transistor adapted to selectively supply a data signal to the driving transistor; a second switching transistor adapted to selectively supply an initialization signal; a third switching transistor adapted to selectively allow the driving transistor to be connected as a diode and to selectively supply the initialization signal; a storage capacitor adapted to store a first voltage corresponding to the initialization signal received from the third switching transistor and then to store a second voltage corresponding to the data signal applied at a gate electrode of the driving transistor; and an interrupter adapted to selectively supply a pixel power to the driving transistor and to selectively allow the driving current to flow in the organic light emitting diode.

One embodiment of the present invention provides a pixel including: a first switching transistor having a source electrode connected to a data line, a drain electrode connected to a first node, and a gate electrode connected to a second scan line; a second switching transistor having a source electrode connected to a second power line, a drain electrode connected to a fourth node, and a gate electrode connected to a first scan line; a third switching transistor having a source electrode connected to the fourth node, a drain electrode connected to the second node, and a gate electrode connected to a third scan line; a fourth switching transistor having a source electrode connected to a first power line, a drain electrode connected to the first node, and a gate electrode connected to an emission control line; a fifth switching transistor having a source electrode connected to a third node, a drain electrode connected to a organic light emitting diode, and a gate electrode connected to the emission control line; a capacitor having a first electrode connected to the first power line, and a second electrode connected to the second node; and a driving transistor having a source electrode connected to the first node, a drain electrode connected to the third node, and a gate electrode connected to the second node.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION

Hereinafter, certain exemplary embodiments according to the present invention will be described with reference to the accompanying drawings. The exemplary embodiments of the present invention are provided to be readily understood by those skilled in the art.

Figure 1:
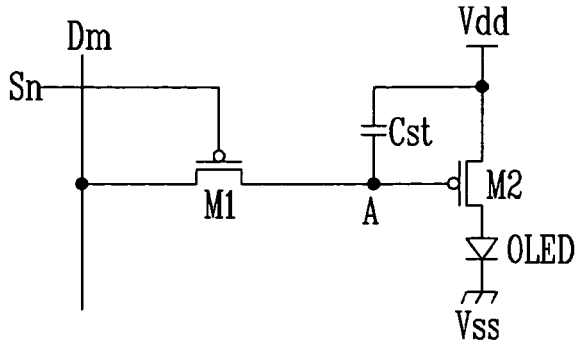
FIG. 1 PRIOR ART
FIG. 1 is a circuit diagram of a pixel in a conventional organic light emitting display.
Figure 2:
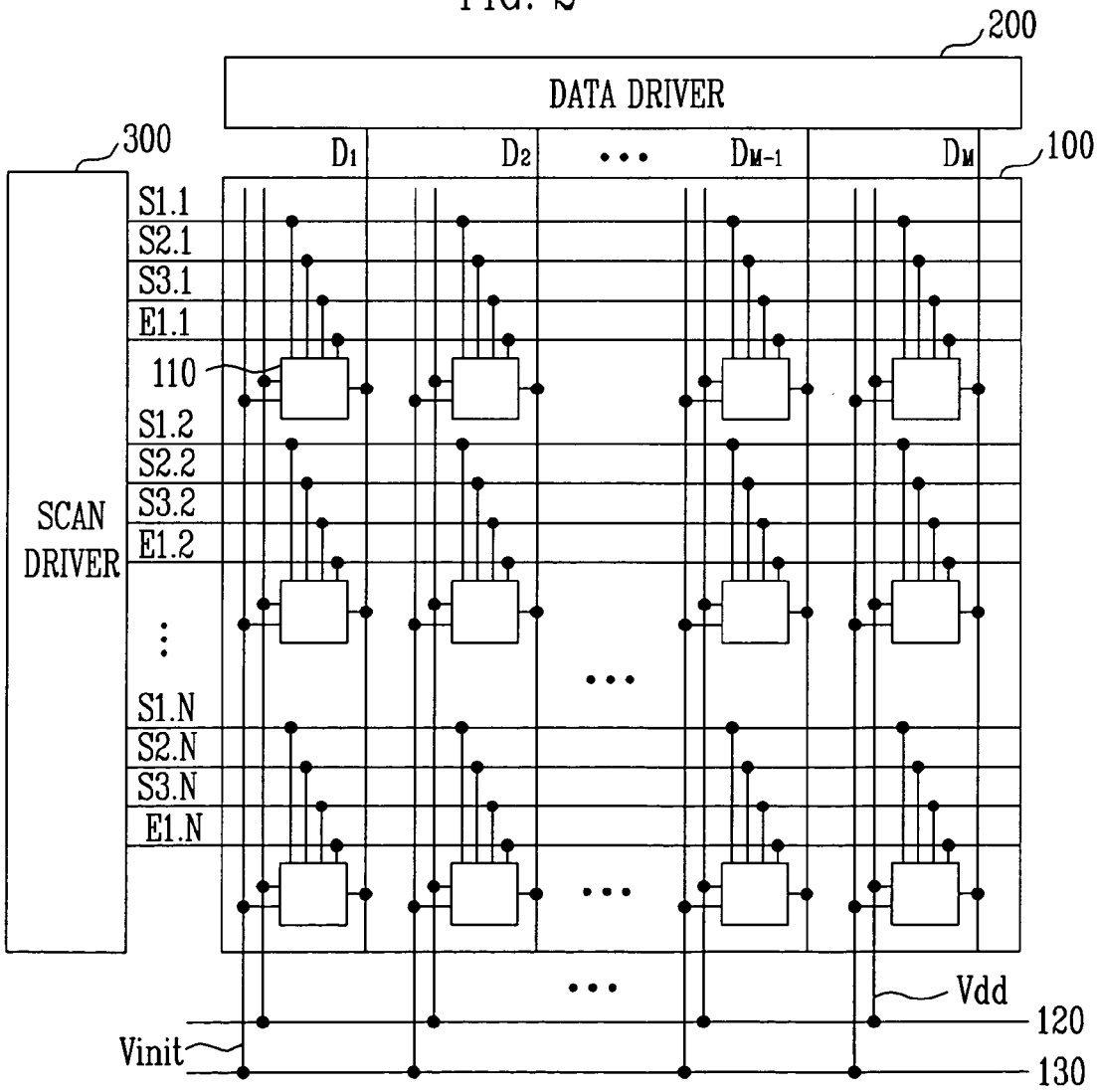
FIG. 2 illustrates a configuration of an organic light emitting display according to an embodiment of the present invention.

FIG. 2 illustrates a configuration of an organic light emitting display according to an embodiment of the present invention. Referring to FIG. 2, the organic light emitting display according to the embodiment of the present invention includes a pixel part 100, a data driver 200, and a scan driver 300.

The pixel part 100 includes N×M pixels 110 having organic light emitting diodes OLED; N first scan lines S1.1, S1.2, . . . , S1.N−1, S1.N arranged in a row direction; N second scan lines S2.1, S2.2, . . . , S2.N−1, S2.N arranged in the row direction; N third scan lines S3.1, S3.2, . . . , S3.N−1, S3.N arranged in the row direction; N emission control lines E1.1, E1.2, . . . , E1.N−1, E1.N arranged in the row direction; M data lines D1, D2, . . . , DM−1, DM arranged in a column direction; M pixel power lines Vdd for supplying a pixel power (e.g., a pixel voltage); and M initialization lines Vinit for supplying a compensation power (e.g., a compensation voltage). The pixel power lines Vdd are connected to a first power line 120 and receive an external power, and the initialization lines Vinit are connected to a second power line 130.

A data signal(s) is transmitted from the data lines D1, D2, . . . , DM−1, DM to a pixel(s) 110 in response to a first scan signal(s), a second scan signal(s) and a third scan signal(s) respectively transmitted from the first scan lines S1.1, S1.2, . . . , S1.N−1, S1.N, the second scan lines S2.1, S2.2, . . . , S2.N−1, S2.N, and the third scan lines S3.1, S3.2, . . . , S3.N−1, S3.N. At this time, a driving transistor (not shown) provided in the pixel 110 generates a driving current corresponding to the data signal. Further, the driving current is transmitted to an organic light emitting diode OLED by an emission control signal(s) transmitted from the emission control lines E1.1, E1.2, . . . , E1.N−1, E1.N, thereby displaying an image. Further, when a predetermined voltage is applied to an initialization line Vinit connected to the pixel 110, a leakage current in the pixel 110 is decreased and a contrast of the pixel 110 is enhanced.

The data driver 200 is connected to the data lines D1, D2, . . . , DM−1, DM and supplies the data signal to the pixel part 100.

The scan driver 300 is provided in a side of the pixel part 100, and connected to the first scan lines S1.1, S1.2, . . . , S1.N−1, S1.N, the second scan lines S2.1, S2.2, . . . , S2.N−1, S2.N, and the third scan lines S3.1, S3.2, . . . , S3.N−1, S3.N to thereby supply the first, second, and third scan signals to the pixel part 100. Further, the scan driver is connected to the emission control lines E1.1, E1.2, . . . , E1.N−1, E1.N to thereby supply the emission control signal to the pixel part 100.

When the first through third scan signals and the emission control signal are supplied to the pixel part 100, predetermined rows of the pixel part 100 are selected in sequence, and the data driver 200 supplies the data signal to the selected row, thereby allowing the pixel 110 corresponding to the selected row to emit light based on the data signal.

Figure 3:
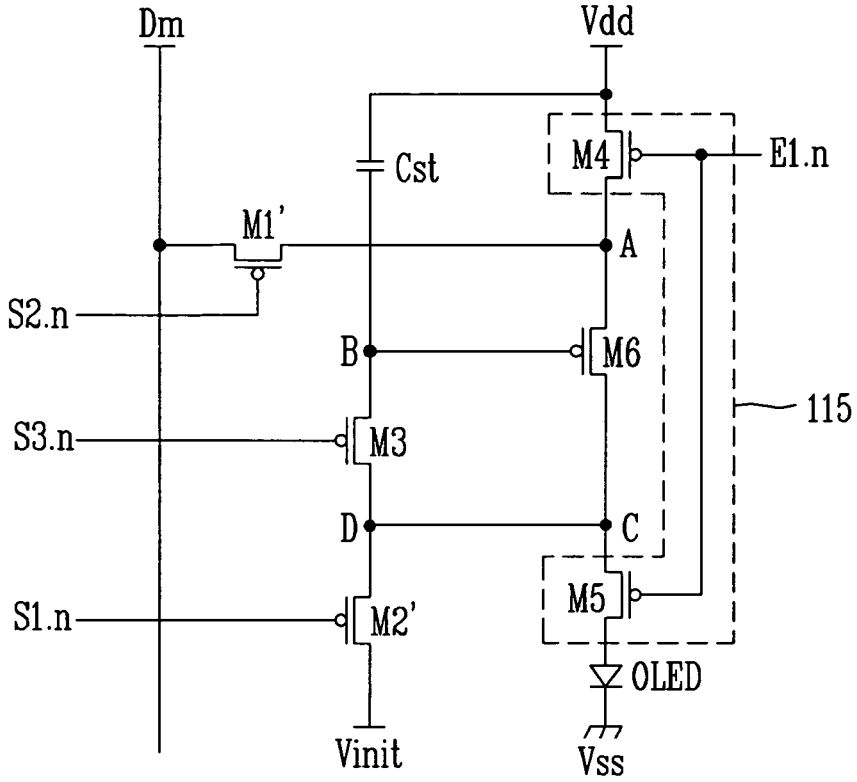
FIG. 3 is a circuit diagram of a pixel according to an embodiment of the present invention.

FIG. 3 is a circuit diagram of a pixel (e.g., the pixel 110) according to an embodiment of the present invention. Referring to FIG. 3, the pixel includes an organic light emitting diode OLED and a peripheral circuit. The peripheral circuit includes a first switching transistor M1', a second switching transistor M2', a third switching transistor M3, a fourth switching transistor M4, a fifth switching transistor M5, a driving transistor M6, and a storage capacitor Cst.

Each of the first through fifth switching transistors M1', M2', M3, M4, and M5, and the driving transistor M6 includes a source electrode, a drain electrode and a gate electrode. Further, the storage capacitor Cst includes a first electrode and a second electrode.

The first switching transistor M1' has its source electrode connected to the data line Dm, its drain electrode connected to a first node A, and its gate electrode connected to the second scan line S2.n. Thus, the first switching transistor M1 supplies the data signal to the first node A in response to the second scan signal transmitted through the second scan line S2.n.

The second switching transistor M2' has its source electrode connected to the initialization line Vinit, its drain electrode connected to a fourth node D, and its gate electrode connected to the first scan line S1.n. Thus, the second switching transistor M2 supplies an initialization signal (e.g., the compensation power or the compensation voltage) to the fourth node D in response to the second scan signal transmitted through the first scan line S1.n.

The third switching transistor M3 has its source electrode connected to the fourth node D, its drain electrode connected to a second node B, and its gate electrode connected to the third scan line S3.n. Thus, the third switching transistor M3 supplies the initialization signal from the fourth node D to the second node B in response to the third scan signal transmitted through the third scan line S3.n.

The fourth switching transistor M4 selectively supplies the pixel power to the first node A, and has its source electrode connected to the pixel power line Vdd, its drain electrode connected to the first node A, and its gate electrode connected to the emission control line E1.n. Thus, the fourth switching transistor M4 selectively supplies the pixel power to the driving transistor M6 in accordance with the emission control signal transmitted through the emission control line E1.n.

The fifth switching transistor M5 has its source electrode connected to a third node C, its drain electrode connected to the organic light emitting diode OLED, and its gate electrode connected to the emission control line E1.n. Thus, the fifth switching transistor M5 selectively supplies a current to the organic light emitting diode OLED in accordance with the emission control signal transmitted through the emission control line E1.n.

Here, the fourth switching transistor M4 and the fifth switching transistor M5 are employed as an interrupter 115 for selectively cutting off the pixel power being supplied to the driving transistor M6 and the current being supplied to the organic light emitting diode OLED, respectively.

The driving transistor M6 has its source electrode connected to the first node A, its drain electrode connected to the third node C, and its gate electrode connected to the second node B. Further, the third node C is connected to the fourth node D through wiring (e.g., an electrically conductive wire). When the third node C and the second node B are equalized in electric potential by operation of the third switching transistor M3, the driving transistor M6 is connected to function as a diode, so that the data signal is transmitted from the first node A to the second node B through the driving transistor M6. Further, when the fourth switching transistor M4 supplies the pixel power to the first node A, the current is supplied from the source electrode of the driving transistor M6 to the drain electrode thereof in correspondence with the voltage applied to the gate electrode of the driving transistor M6. That is, the intensity of the current is determined according to the electric potential of the second node B.

The storage capacitor Cst has its first electrode connected to the pixel power line Vdd, and its second electrode connected to the second node B. Thus, the storage capacitor Cst stores an initialization voltage when the initialization signal is transmitted from the second node B to the storage capacitor Cst by the second switching transistor M2', and stores a voltage corresponding to the data signal when the data signal is transmitted to the driving transistor by the first and third switching transistors M1' and M3. Further, the storage capacitor Cst supplies the stored voltage from the second node B to the gate electrode of the driving transistor M6.

Figure 4:
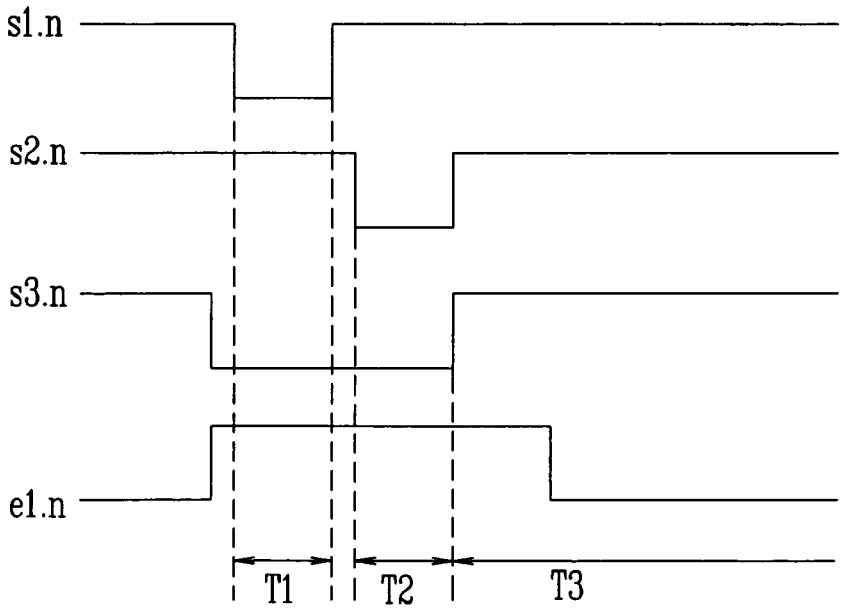
FIG. 4 illustrates a timing diagram for operating the pixel in association with FIG. 3.

FIG. 4 illustrates a timing diagram for operating the pixel in association with FIG. 3. Referring to FIG. 4, the first scan signal s1.*n*, the second scan signal s2.n, the third scan signal s3.n, and the emission control signal e1.n are inputted to the pixel, thereby operating the pixel. Here, the first scan signal s1.n, the second scan signal s2.n, the third scan signal s3.n, and the emission control signal e1.*n* are periodical signals that each include a first period T1, a second period T2, and a third period T3, wherein the third period T3 lasts until one frame is finished.

The first scan signal s1.n is maintained in a low state (e.g., a low voltage level) for the first period T1, and in a high state (e.g., a high voltage level) for the second and third periods T2 and T3. The second scan signal s2.n is maintained in the high state for the first and third periods T1 and T3, and in the low state for the second period T2. The third scan signal s3.n is maintained in the low state for the first and second periods T1 and T2, and in the high state for the third period T3. The emission control signal e1.n is maintained in the high state for the first and second periods T1 and T2, and in the low state for a part (e.g., an end part) of the third period T3. That is, the emission control signal e1.n is shifted into the low state after a lapse of a predetermined time from the beginning of the third period T3.

For the first period T1, the second switching transistor M2' is turned on by the first scan signal s1.n, and the third switching transistor M3 is turned on by the third scan signal s3.n. Thus, the initialization signal is transmitted to the second node B through the fourth node D, thereby initializing the storage capacitor Cst (i.e., the storage capacitor Cst is initialized by the initialization signal).

For the second period T2, the first switching transistor M1' is turned on by the second scan signal s2.n, and the third switching transistor M3 is turned on by the third scan signal s3.n. Thus, the data signal is transmitted to the first node A through the first switching transistor M1', and the second node B and the third node C are equalized in the electric potential by the third switching transistor M3, so that the driving transistor M6 is connected to function as a diode, thereby transmitting the data signal from the first node A to the second node B.

Hence, the storage capacitor Cst is charged with the voltage calculated by the following equation 2, so that the voltage based on the following equation 2 is applied between the source and gate electrodes of the driving transistor M6.

$$Vgs = Vdd - (Vdata - Vth) \quad \text{[equation 2]}$$

where, Vgs is a voltage applied between the source and gate electrodes of the driving transistor M6; Vdd is a voltage of the pixel power; Vdata is a voltage of the data signal; and Vth is the threshold voltage of the driving transistor M6.

For the third period T3, the fourth switching transistor M4 and the fifth switching transistor M5 are turned on by the emission control signal, so that the pixel power is supplied to the driving transistor M6. At this time, the voltage based on the equation 2 is applied to the gate electrode of the driving transistor M6, so that current based on the following equation 3 is supplied from the source electrode to the drain electrode of the driving transistor M6.

$$I_{OLED} = \frac{\beta}{2}(Vgs - Vth)^2 = \frac{\beta}{2}(Vdd - Vdata + Vth - Vth)^2 = \frac{\beta}{2}(Vdd - Vdata)^2 \quad \text{[equation 3]}$$

where, $I_{OLED}$ is a current flowing in the organic light emitting diode OLED; Vgs is a voltage applied between the source and gate electrodes of the driving transistor M6; Vdd is a voltage of the pixel power; Vth is the threshold voltage of the driving transistor M6; Vdata is a voltage of the data signal; and β is a gain factor of the driving transistor M6.

Thus, the current flows in the organic light emitting diode OLED regardless of the threshold voltage of the driving transistor M6.

Figure 5:
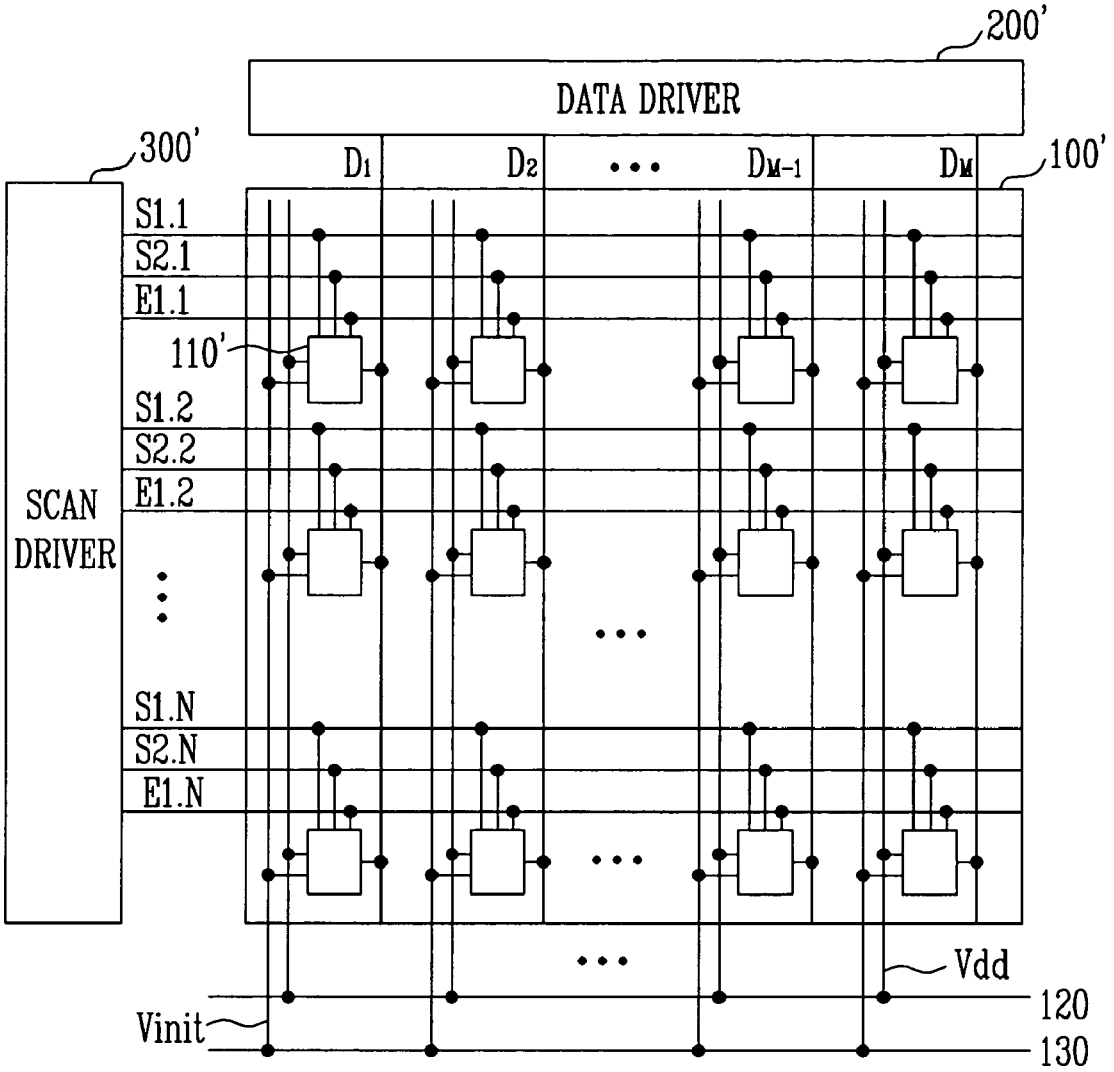
FIG. 5 illustrates a configuration of an organic light emitting display of a comparative example.

FIG. 5 illustrates a configuration of an organic light emitting display of a comparative example. Referring to FIG. 5, the organic light emitting display of the comparative example includes a pixel part 100', a data driver 200', and a scan driver 300'.

The pixel part 100 includes N×M pixels 110' having organic light emitting diodes OLED; N first scan lines S1.1, S1.2, . . . , S1.N−1, S1.N arranged in a row direction; N second scan lines S2.1, S2.2, . . . , S2.N−1, S2.N arranged in the row direction; N emission control lines E1.1, E1.2, . . . , E1.N−1, E1.N arranged in the row direction; M data lines D1, D2, . . . , DM−1, DM arranged in a column direction; M pixel power lines Vdd for supplying a pixel power (e.g., a pixel voltage); and M initialization lines Vinit for supplying a compensation power (e.g., a compensation voltage). The pixel power lines Vdd are connected to a first power line 120 and receive an external power, and the initialization lines Vinit are connected to a second power line 130.

A data signal is transmitted from the data lines D1, D2, . . . , DM−1, DM to a pixel(s) 110' in response to a first scan signal(s) and a second scan signal(s) respectively transmitted from the first scan lines S1.1, S1.2, . . . , S1.N−1, S1.N, and the second scan lines S2.1, S2.2, . . . , S2.N−1, S2.N. At this time, a driving transistor (not shown) provided in the pixel 110' generates a driving current corresponding to the data signal. Further, the driving current is transmitted to an organic light emitting diode OLED by an emission control signal(s) transmitted from the emission control lines E1.1, E1.2, . . . , E1.N−1, E1.N, thereby displaying an image.

The data driver 200' is connected to the data lines D1, D2, . . . , DM−1, DM and supplies the data signal to the pixel part 100'.

The scan driver 300' is provided in a side of the pixel part 100', and connected to the first scan lines S1.1, S1.2, . . . , S1.N−1, S1.N, and the second scan lines S2.1, S2.2, . . . , S2.N−1, S2.N to thereby supply the first and second scan signals to the pixel part 100'. Further, the scan driver is connected to the emission control lines E1.1, E1.2, . . . , E1.N−1, E1.N to thereby supply the emission control signal to the pixel part 100'.

When the first and second scan signals and the emission control signal are supplied to the pixel part 100', predetermined rows of the pixel part 100' are selected in sequence, and the data driver 200' supplies the data signal to the selected row, thereby allowing the pixel 110' corresponding to the selected row to emit light based on the data signal.

Figure 6:
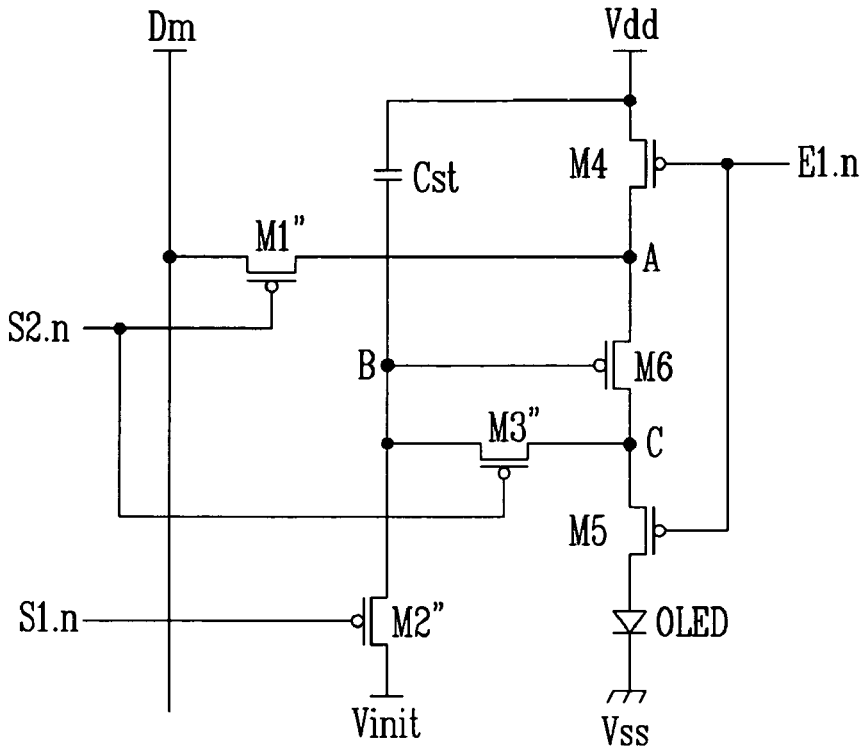
FIG. 6 is a circuit diagram of a pixel in association with FIG. 5.

FIG. 6 is a circuit diagram of a pixel (e.g., the pixel 110') in association with FIG. 5. Referring to FIG. 6, a source electrode of a third switching transistor M3" is connected to a third node C, so that an initialization signal is transmitted to a second node B through only a second switching transistor M2". Further, gate electrodes of first and third switching transistors M1" and M3" are connected to a second scan line S2.n to thereby operate substantially in the same manner.

Figure 7:
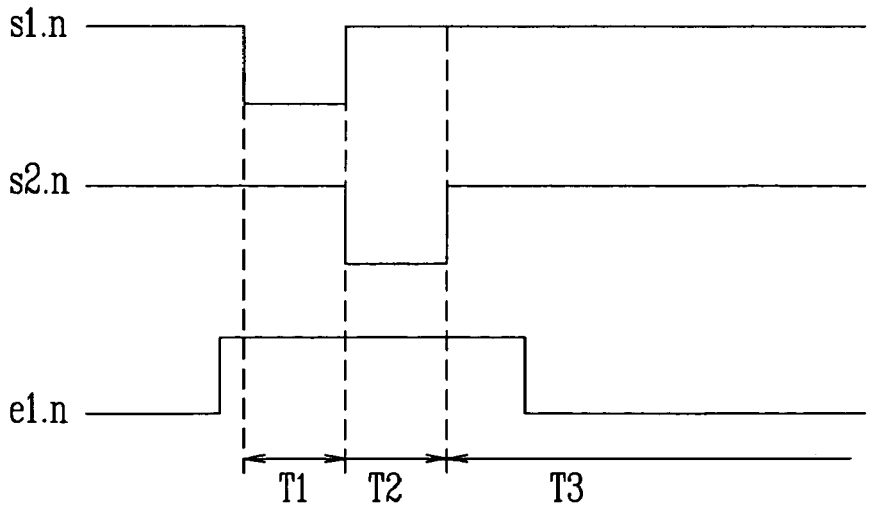
FIG. 7 illustrates a timing diagram for operating the pixel in association with FIG. 6.

FIG. 7 illustrates a timing diagram for operating the pixel in association with FIG. 6. Referring to FIG. 7, the first scan signal s1.n, the second scan signal s2.n, and the emission control signal e1.n are inputted to the pixel, thereby operating the pixel. Here, the first scan signal s1.n, the second scan signal s2.n, and the emission control signal e1.n are periodical signals that each include a first period T1, a second period T2, and a third period T3, wherein the third period T3 lasts until one frame is finished.

The first scan signal s1.n is maintained in a low state for the first period T1, and in a high state for the second and third periods T2 and T3. The second scan signal s2.n is maintained in the high state for the first and third periods T1 and T3, and in the low state for the second period T2. The emission control signal e1.n is maintained in the high state for the first and second periods T1 and T2, and in the low state for a part of the third period T3. That is, the emission control signal e1.n is shifted into the low state after a lapse of a predetermined time from the beginning of the third period T3.

For the first period T1, the second switching transistor M2" is turned on by the first scan signal s1.n, so that the initialization signal is transmitted to the second node B, thereby allowing the storage capacitor Cst to store the initialization signal.

For the second period T2, the first and third switching transistors. M1" and M3" are turned on by the second scan signal s2.n, so that the data signal is transmitted to the first node A through the first switching transistor M1" and the second node B and the third node C are equalized in the electric potential by the third switching transistor M3", thereby allowing the driving transistor M6 to be connected to function as a diode. As a result, the data signal is transmitted from the first node A to the second node B.

Hence, the storage capacitor Cst is charged with the voltage based on the foregoing equation 2, so that the voltage Vgs based on the foregoing equation 2 is applied between the source and gate electrodes of a driving transistor M6.

For the third period T3, a fourth switching transistor M4 and a fifth switching transistor M5 are turned on by the emission control signal, so that the pixel power is supplied to the driving transistor M6. At this time, the voltage based on the foregoing equation 2 is applied to the gate electrode of the driving transistor M6, so that current based on the foregoing equation 3 is supplied from the source electrode to the drain electrode of the driving transistor M6.

Thus, referring also to the foregoing equation 3, the current flows in the organic light emitting diode OLED regardless of the threshold voltage of the driving transistor M6.

Comparing the pixel of FIG. 3 with the pixel of FIG. 6, in the pixels shown in FIGS. 3 and 6, the voltage stored in the storage capacitor Cst may leak out through the second and third switching transistor M2 and M3, so that the voltage applied to the gate electrode of the driving transistor M6 is gradually dropped.

Particularly, when a black gradation signal for emitting no light is a high signal and the high signal is transmitted to the gate electrode of the driving transistor M6, no current should flow through the driving transistor M6, so that the organic light emitting diode OLED does not emit light. However, although the data signal corresponding to the black gradation signal is inputted to the gate electrode of the driving transistor M6, the voltage applied to the gate electrode is lowered due to the leakage current, and thus a current does flow through the driving transistor M6. Thus, an area of the image displaying part that should be dark may be bright.

In the case of the pixel shown in FIG. 3, when the voltage of the initialization signal is equalized to the voltage of the third node C provided in the pixel corresponding to the black gradation, the voltage of the third node C is equalized to the voltage of the initialization signal, so that the voltage applied to the second node B is prevented from leaking out toward the initialization line Vinit through the second switching transistor M2.

Thus, the leakage current flows from the fourth node D to the organic light emitting diode OLED, thereby reducing the amount of the leakage current. Hence, the voltage drop in the storage capacitor Cst is decreased.

On the other hand, in the case of the pixel shown in FIG. 6, even though the voltage of the initialization signal is equalized to the voltage of the third node C provided in the pixel corresponding to the black gradation, the voltage of the second node B, the voltage of the initialization signal, and the voltage of the third node C are different from one another, so that a first path is formed to allow the leakage current to flow toward the third node C and a second path is formed to allow the leakage current to flow from the second node B through the initialization signal line. Hence, the voltage stored in the storage capacitor Cst provided in the pixel of FIG. 6 leaks out faster than the pixel of FIG. 3 (i.e., the two leakage paths of FIG. 6 leak current faster than the one leakage path of FIG. 3), and thus the voltage drop in the storage capacitor Cst provided in the pixel of FIG. 6 is higher (or is increased faster) than the pixel of FIG. 3.

Figure 8:
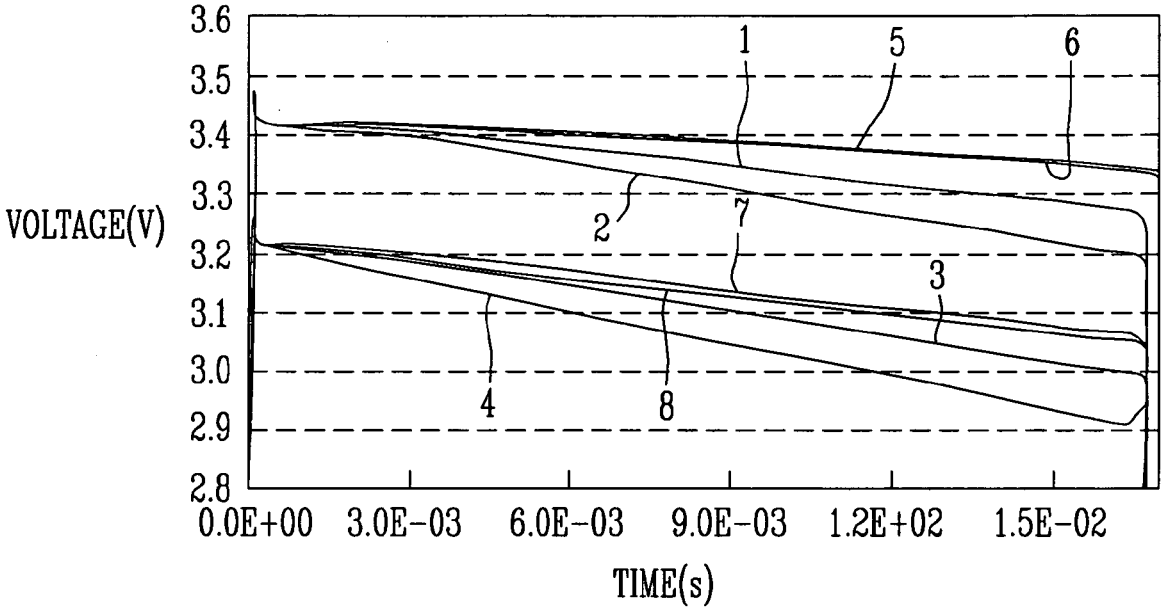
FIG. 8 is a graph showing variations of voltages applied to a gate electrode of the pixels in association with FIGS. 3 and 6.

FIG. 8 is a graph showing variations of voltages applied to a gate electrode of the pixels in association with FIGS. 3 and 6. In FIG. 8, the second switching transistor M2' or M2" and/or the third switching transistor M3' or M3" can be classified into a single gate electrode type and/or a dual gate electrode type, and the voltage variances of the gate electrode are shown during one frame. Reference numerals shown in FIG. 8 are described in the following table 1.

TABLE 1

| | | Second switching transistor | Third switching transistor |
|---|---|---|---|
| 1 | Pixel | Dual gate electrode | Dual gate electrode |
| 2 | of FIG. 6 | Dual gate electrode | Single gate electrode |
| 3 | | Single gate electrode | Dual gate electrode |
| 4 | | Single gate electrode | Single gate electrode |
| 5 | Pixel | Dual gate electrode | Dual gate electrode |
| 6 | of FIG. 3 | Dual gate electrode | Single gate electrode |
| 7 | | Single gate electrode | Dual gate electrode |
| 8 | | Single gate electrode | Single gate electrode |

Referring to FIG. 8, the leakage current in the dual gate electrode type transistor is smaller than that in the single gate electrode type transistor. Further, the leakage current in the pixel shown in FIG. 3 is smaller than that in the pixel shown in FIG. 6. Also, the leakage current in the dual gate electrode type transistor used in the pixel shown in FIG. 6 is approximately equal to that in the single gate electrode type transistor used in the pixel shown in FIG. 3.

Also, in a pixel of the present invention, connections between the first through third scan lines and the emission control line are not limited to the foregoing description in association with FIGS. 2 through 8, and may vary as appreciated by those skilled in the art.

As described above, an embodiment of the present invention provides an organic light emitting display, in which a current flows through a driving transistor regardless of a threshold voltage of the driving transistor, so that a difference between threshold voltages of driving transistors is compensated, thereby uniformizing a brightness of the organic light emitting display.

Further, an embodiment of the present invention provides an organic light emitting display, in which the amount of current leaking out through a switching transistor is decreased, and thus a voltage variance applied to a gate electrode of a driving transistor is decreased, thereby enhancing a contrast of an image.

Although certain embodiments of the present invention have been shown and described, it would be appreciated by those skilled in the art that changes might be made in these embodiments without departing from the principles and spirit of the invention, the scope of which is defined in the claims and their equivalents.

What is claimed is:

1. An organic light emitting display comprising:
a plurality of scan lines adapted to transmit a scan signal;
a plurality of data lines adapted to transmit a data signal;
a plurality of emission control lines; and
a plurality of pixels connected to the scan lines, the emission control lines, and the data lines,
wherein at least one of the pixels comprises
an organic light emitting diode;
a driving transistor adapted to supply a driving current to the organic light emitting diode;
a first switching transistor adapted to selectively supply the data signal to the driving transistor;
a second switching transistor adapted to selectively supply an initialization signal;
a third switching transistor adapted to selectively allow the driving transistor to be connected as a diode and to selectively supply the initialization signal;
a storage capacitor adapted to store a first voltage corresponding to the initialization signal received from the third switching transistor and then to store a second voltage corresponding to the data signal applied at a gate electrode of the driving transistor; and
an interrupter adapted to selectively supply a pixel power to the driving transistor and to selectively allow the driving current to flow into the organic light emitting diode.

2. The organic light emitting display according to claim 1, wherein the scan signal comprises a first scan signal, a second scan signal, and a third scan signal, and wherein the first switching transistor operates in response to the first scan signal, the second switching transistor operates in response to the second scan signal, and the third switching transistor operates in response to the third scan signal.

3. The organic light emitting display according to claim 1, wherein the interrupter comprises a fourth switching transistor adapted to selectively interrupt the pixel power, and a fifth switching transistor adapted to selectively interrupt the driving current.

4. The organic light emitting display according to claim 1, wherein the second voltage has a voltage level obtained by subtracting a threshold voltage of the driving transistor from a voltage of the data signal to obtain a differentiated voltage and then subtracting the differentiated voltage from the first voltage.

5. The organic light emitting display according to claim 1, wherein the second switching transistor and/or the third switching transistor has a dual gate structure.

6. The organic light emitting display according to claim 1, wherein a voltage of the initialization signal is equal to a voltage applied to a drain electrode of the driving transistor when the data signal is a black gradation level signal.

7. The organic light emitting display according to claim 1, further comprising a scan driver connected to the scan lines, wherein the scan signal comprises a first scan signal, a second scan signal, and a third scan signal, and wherein the scan driver supplies the first scan signal, the second scan signal, and the third scan signal.

8. The organic light emitting display according to claim 7, further comprising a data driver connected to the data lines and adapted to supply the data signal.

9. A pixel comprising:

an organic light emitting diode;

a driving transistor adapted to supply a driving current to the organic light emitting diode;

a first switching transistor adapted to selectively supply a data signal to the driving transistor;

a second switching transistor adapted to selectively supply an initialization signal;

a third switching transistor adapted to selectively allow the driving transistor to be connected as a diode and to selectively supply the initialization signal;

a storage capacitor adapted to store a first voltage corresponding to the initialization signal received from the third switching transistor and then to store a second voltage corresponding to the data signal applied at a gate electrode of the driving transistor; and an interrupter adapted to selectively supply a pixel power to the driving transistor and to selectively allow the driving current to flow in the organic light emitting diode.

10. The pixel according to claim 9, wherein the first switching transistor operates in response to a first scan signal, the second switching transistor operates in response to a second scan signal, and the third switching transistor operates in response to a third scan signal.

11. The pixel according to claim 9, wherein the interrupter comprises a fourth switching transistor adapted to selectively interrupt the pixel power, and a fifth switching transistor adapted to selectively interrupt the driving current.

12. The pixel according to claim 9, wherein the second voltage has a voltage level obtained by subtracting a voltage of the data signal from a threshold voltage of the driving transistor and then from the first voltage.

13. The pixel according to claim 9, wherein the second switching transistor and/or the third switching transistor has a dual gate structure.

14. The pixel according to claim 9, wherein a voltage of the initialization signal is equal to a voltage applied to a drain electrode of the driving transistor when the data signal is a black gradation level signal.

15. The pixel according to claim 9, further comprising means for blocking a voltage from leaking through the second switching transistor.

16. A pixel comprising:

a first switching transistor having a source electrode connected to a data line, a drain electrode connected to a first node, and a gate electrode connected to a second scan line;

a second switching transistor having a source electrode connected to a second power line, a drain electrode connected to a fourth node, and a gate electrode connected to a first scan line;

a third switching transistor having a source electrode connected to the fourth node, a drain electrode connected to a second node, and a gate electrode connected to a third scan line;

a fourth switching transistor having a source electrode connected to a first power line, a drain electrode connected to the first node, and a gate electrode connected to an emission control line;

a fifth switching transistor having a source electrode connected to a third node, a drain electrode connected to a organic light emitting diode, and a gate electrode connected to the emission control line;

a capacitor having a first electrode connected to the first power line, and a second electrode connected to the second node; and a driving transistor having a source electrode connected to the first node, a drain electrode connected to the third node, and a gate electrode connected to the second node.

17. The pixel according to claim 16, wherein a voltage applied to the second power line is equal to a voltage applied to the third node when the data signal is a black gradation level signal.

18. The pixel according to claim 16, wherein the second switching transistor and/or the third switching transistor has a dual gate structure.

19. The pixel according to claim 16, further comprising means for blocking a voltage at the second node from leaking toward the second power line through the second switching transistor.

20. A method of decreasing an amount of current leaking out through a switching transistor of a pixel of an organic light emitting display, the method comprising:

allowing a driving transistor to be connected as a diode selectively through a third switching transistor;

supplying an initialization signal selectively through a second switching transistor and a third switching transistor;

storing a first voltage corresponding to the initialization signal received from the third switching transistor in a storage capacitor;

supplying a data signal to the driving transistor selectively through a first switching transistor;

storing a second voltage corresponding to the data signal applied at a gate electrode of the driving transistor in the storage capacitor; and supplying a pixel power to the driving transistor selectively through a fourth switching transistor;

supplying a driving current from the driving transistor to an organic light emitting diode; and allowing the driving current to flow into the organic light emitting diode selectively through a fifth switching transistor.

21. The method according to claim 20, wherein a gate of the fourth switching transistor is electrically connected to a gate of the fifth switching transistor.

* * * * *